US005195920A

United States Patent [19]

Collier

[11] Patent Number: 5,195,920

[45] Date of Patent: * Mar. 23, 1993

[54] RADIO CONTROLLED MODEL VEHICLE HAVING COORDINATED SOUND EFFECTS SYSTEM

[76] Inventor: Harry B. Collier, 1356 E. Goldsmith Dr., Highlands Ranch, Colo. 80126

[ * ] Notice: The portion of the term of this patent subsequent to Oct. 23, 2007 has been disclaimed.

[21] Appl. No.: 599,659

[22] Filed: Oct. 18, 1990

Related U.S. Application Data

[63] Continuation of Ser. No. 312,063, Feb. 16, 1989, Pat. No. 4,964,837.

[51] Int. Cl.[5] ..... A63H 5/00; A63H 30/04; A63H 30/00; A63H 29/22

[52] U.S. Cl. ..... 446/409; 446/456; 446/175; 446/484

[58] Field of Search ..... 446/454, 456, 409, 410, 446/404, 269, 270, 271, 272, 175, 484, 485, 431, 448; 273/86 B

[56] References Cited

U.S. PATENT DOCUMENTS

| | | | |
|---|---|---|---|
| 3,274,729 | 9/1965 | Rafabert | 446/191 |
| 3,466,797 | 9/1969 | Hellsund | 446/410 |
| 3,664,060 | 5/1972 | Longnecker | 446/410 |
| 3,839,822 | 10/1974 | Rexford | 446/410 |
| 4,219,962 | 9/1980 | Dankmann et al. | 446/409 |
| 4,274,225 | 6/1981 | Knauff et al. | 446/409 |
| 4,291,877 | 9/1981 | Ensmann et al. | 446/409 X |
| 4,318,245 | 3/1982 | Stowell et al. | 446/303 |
| 4,325,199 | 4/1982 | McEdwards | 446/409 X |
| 4,333,258 | 6/1982 | McCaslin | 446/397 X |
| 4,383,386 | 5/1988 | Giordano et al. | 446/387 |
| 4,569,919 | 4/1987 | Price | 446/397 X |
| 4,675,519 | 6/1987 | Price | 446/397 |
| 4,946,416 | 8/1990 | Stern et al. | 446/485 X |
| 4,964,837 | 10/1990 | Collier | 446/456 X |

FOREIGN PATENT DOCUMENTS

| | | | |
|---|---|---|---|
| 0151250 | 8/1985 | European Pat. Off. | 446/456 |
| 3009 | 9/1981 | Fed. Rep. of Germany | 446/456 |
| 2625446 | 7/1989 | France | 446/409 |
| 1436814 | 6/1976 | United Kingdom | 446/410 |

OTHER PUBLICATIONS

Texas Instruments, "The Linear Circuits Data Book 1983", pp. 8-174-8-176 and 8-210-8-216.

Texas Instruments Bulletin No. DL-S 12612, Jul. 1978, "Type SN/6477 Complex Sound Generator".

Commodore, "Programmer's Reference Guide", Appendix O, 6581 Sound Interface Device (SID) Chip Specifications, pp. 457-459, 481, 1982.

"Onboard, Locomotive Sound & Control System" Cataloque, Feb. 85, 6 pages.

"Right-of-Way Industries", Advertisement, Dec. 1987.

"All Aboard", Advertisement, Dec 1987.

Knott et al., "101 Projects, Plans and Ideas for the High-Tech Household", No. 2642, pp. 69-73, Tab Books, Inc., 1986.

Horn, "How to Use Special-Purpose ICs", No. 2625, pp. 128-152, Tab Books, Inc. 1986.

*Primary Examiner*—D. Neal Muir

*Attorney, Agent, or Firm*—Dorr, Carson, Sloan & Peterson

[57] ABSTRACT

The self-contained sound effects system for a model radio controlled toy vehicle. The conventional internal control signals of the vehicle are detected by the present invention and are utilized to generate realistic sound effects on board the vehicle. The sound data and programming necessary to coordinate the realistic sound effects with the conventional on-board control signals are entirely contained on the vehicle. A microprocessor is used to provide the coordination of the sound data with the programming and the microprocessor modifies the sound effects with any changes in the on-board control signals by varying the pitch, timbre, amplitude, and the like of the sound effects. A communications port is also provided on the vehicle so that when connected with a remote computer, the sound data and programming can be selectively modified by the operator to add new sound effects or to change current sound effects and operating software.

25 Claims, 6 Drawing Sheets

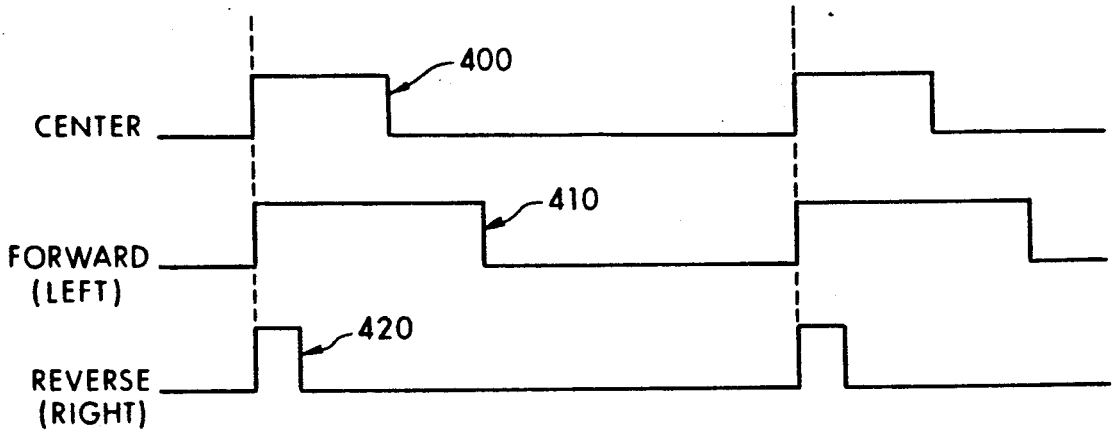
Fig. 4
(Prior Art)
Fig. 5
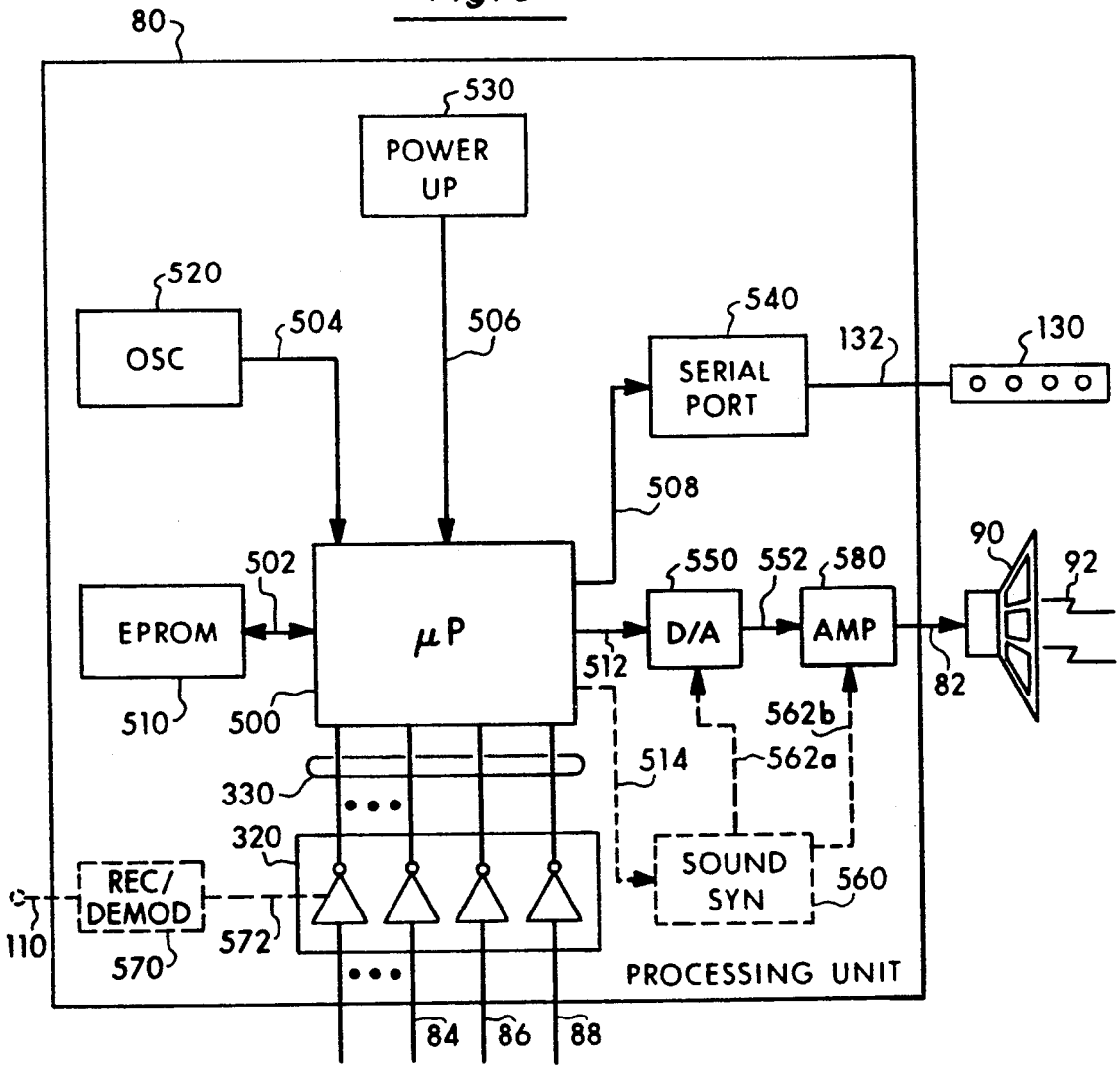

Fig. 8
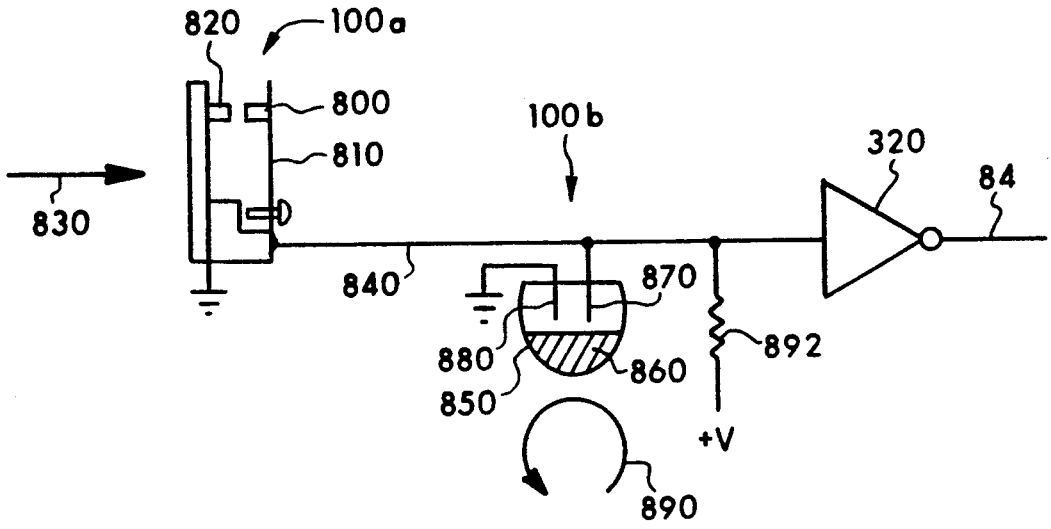
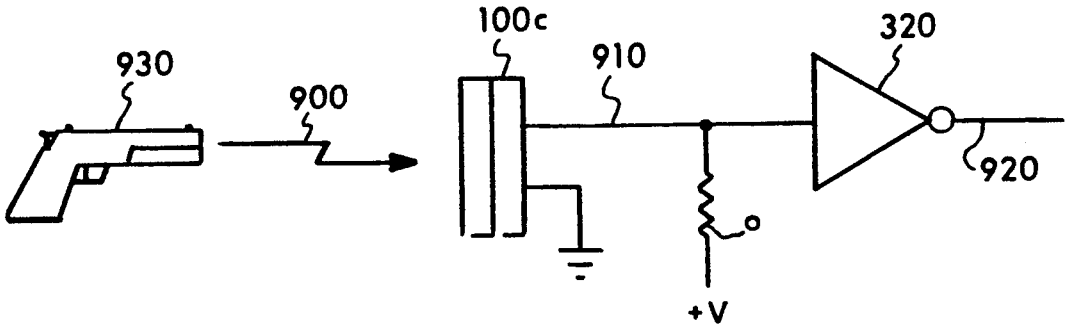
Fig. 9

RADIO CONTROLLED MODEL VEHICLE HAVING COORDINATED SOUND EFFECTS SYSTEM

This is a continuation of application Ser. No. 07/312,063, filed Feb. 16, 1989, now U.S. Pat. No. 4,964,837.

BACKGROUND OF THE INVENTION

1. Field of the Invention

The present invention pertains to radio controlled toys and, more particularly, to radio controlled model vehicles capable of producing realistic sound effects.

2. Statement of the Problem

Radio controlled model toys such as race cars, four-wheel off-road trucks, boats, airplanes, and similar vehicles are popular not only among young people but also among adult hobbyists.

A need exists to provide electronic circuitry in such model vehicles to realistically create sound effects such as engine noise, tire sounds, gear shifting, crash sounds, honking, and other types of sounds.

The inventor, prior to making an application for this invention, effectuated a search of issued patents. The results of this search included the following:

| Inventor | Patent No. | Issue Date |
|---|---|---|
| Rafabert | 3,274,729 | 9-27-66 |
| Neuhierl | DE 3009-040 | 1981 |
| Stowell et al. | 4,318,245 | 3-9-82 |
| McEdwards | 4,325,199 | 4-20-82 |
| McCaslin | 4,333,258 | 6-8-82 |
| Giordano et al. | 4,383,386 | 5-17-83 |
| Price | 4,659,919 | 4-21-87 |
| Price | 4,675,519 | 6-23-87 |

The 1981 patent to Neuhierl discloses a radio controlled model vehicle being operated by a remote control transmitter. The remote control transmitter is modified to include a microphone which is used to transmit modulated sound to the vehicle, where it is demodulated and emitted by a loud speaker mounted on the vehicle chassis. The vehicle chassis also holds the drive motor, the battery clamp, the servo mechanism, the receiving antenna and the receiver. A tape player recorder can also be connected to the transmitter, allowing any desired sound to be emitted from the vehicle such as music and speech. Neuhierl discloses the use of an inertia switch mounted on the vehicle chassis which when activated allows tire squeal sounds to be played when the vehicle breaks or turns sharply. The sound of the squeal being played from the tape recorder to the vehicle is broadcast through the speaker.

The 1982 patent to McEdwards sets forth a remote controlled car driven by an electric motor energized with a battery that has an internal combustion engine sound simulator that transmits signals to one or more remote receivers having audio outputs that simulate an internal combustion engine driving the car. The engine sound simulating apparatus utilizes a digital switch sensor responsive to the speed of rotation of the drive wheel of the vehicle producing the output signal. McEdwards utilizes a signal converting circuit that receives the output signal from the digital switch sensor to provide a signal having a frequency that changes in response to ranges of speed of the car. A transmitter connected to the signal converting circuit transmits the signals to the remotely located receivers. The receivers have speakers for producing an audible output simulating the operation of an internal combustion engine.

The 1983 patent to Giordano pertains to a toy skillet that generates realistic "frying" noises. Similarly, the 1982 patent to McCaslin pertains to a kitchen sink and stove toy having electronic sounds simulating water flowing through the tap, a tea kettle whistle, sizzle of meat cooking, etc.

Finally, the patents to Price and Stowell provide sound effects for dolls.

A need exists for a fully self-contained system and apparatus for realistically generating sounds for a radio controlled model vehicle or toy wherein the sensors, the source of the sound, and the speaker for audibly generating the sounds are all located on the actual vehicle. Neuhierl utilizes an approach where the sound is remotely generated on the remote transmitter and transmitted to the vehicle for rebroadcasting from the vehicle. The McEdwards approach generates a "putt-putt" type of sound from the vehicle, but relies upon remotely located speakers for broadcasting the sound. These approaches are fixed to particular sounds and are also limited as to the type of sounds generated.

A need therefore exists, which is not taught by the above approaches, for a self-contained system that not only has the capability of generating or producing a plurality of different sound effects, but also broadcasting the sound effects coordinated in response to internal control signals integrally located on the vehicle.

Furthermore, a need exists for a flexible sound effects system for a radio controlled model vehicle that responds to remote asynchronous sound effects (such as machine gun fire) but is fully self-contained with respect to the source of the sound and the broadcast of the sound. Again, the above prior approaches do not show or teach such an approach.

A need also exists for a system which coordinates the different sounds (e.g., tire squealing, gear-shifting, motor noise) to realistically create true-to-life sounds.

Finally, such a self-contained sound effect system must be rugged, compact, waterproof, low in weight and power, and capable of being added to model vehicles either as original equipment during manufacture or as a retrofit to existing vehicles.

3. Solution of the Problem

The sound effects system for a radio controlled model vehicle of .the present invention provides a solution to the above problem.

The sound effects system of the present invention is a self-contained system entirely located on a model radio controlled vehicle such as a car, tank, boat, airplane, and the like. The self-contained sound effects system of the present invention provides a portfolio of realistically generated sounds instantaneously responding to (a) the actual control signals on the vehicle (i.e., turning left, accelerating), (b) the physical condition of the vehicle (i.e., crashing, roll-over), and (c) the presence of an external stimulus (i.e., a beam of light directed at the vehicle). The self-contained sound effects system of the present invention is further responsive to asynchronously generated remote signal such as from the transmitter wherein the operator of the radio controlled model vehicle can selectively activate asynchronous sound effects (i.e., the sound of machine gun fire, rocket launching, and the like).

The present invention provides a portfolio of sound effects, all of which are stored in appropriate circuitry on the vehicle and which are selectively outputted in accordance with a software program to realistically coordinate the sound effects with the action of the toy vehicle. For example, the toy vehicle could be accelerating and, hence, the sound effects being generated are those of an accelerating motor, gear shifting, and tires squealing. While the car is accelerating, a crash can be sensed and the system immediately reacts to produce a crash sound.

The present invention is self-contained, is rugged, compact, water-proof, and low in weight and power.

In addition, the present invention utilizes a computer port for interconnection to a personal computer wherein the software controlling the sound effects can be selectively changed by the user of the present invention and wherein the user can further change the nature of the sound effects.

SUMMARY OF THE INVENTION

A self-contained sound effects system for a model radio controlled vehicle is disclosed herein. The vehicle conventionally contains a remote transmitter for transmitting radio signals to the vehicle, a receiver/-demodulator for receiving the transmitted radio signals and demodulating them down into a group of internal control signals for the operation of the vehicle.

The present invention utilizes detectors for sensing the presence of the internal control signals, a microprocessor interconnected with the detectors which is responsive to the detection of the internal control signals for selectively sequencing through a state table of programmed sound effects, a memory for storing the programs, a memory for storing the sound effects, and devices for outputting the sound effects together in a coordinated fashion based upon the status of the internal control signals. A loud speaker is placed on the vehicle for broadcasting the coordinated sound effects produced by the self-contained system of the present invention.

The present invention can either be added to radio controlled model vehicles during manufacture as original equipment or it can be added to existing vehicles as a retrofit in a kit form.

In addition, the self-contained system of the present invention is sensitive to the output of sensors which sense the physical condition of the vehicle such as a crash or a roll-over, to external stimulus directed towards the vehicle such as a beam of light and a wave of sound, or from a remote location asynchronously generated by the user of the present invention such as the activation of a button on the radio transmitter for producing a machine gun fire, rocket propulsion, or the like.

DESCRIPTION OF THE DRAWING

FIG. 4 illustrates the control pulse of one type of prior art control system;

FIG. 5 sets forth the block diagram details of the processing unit of the present invention;

FIG. 8 represents an illustration showing two different types of sensors for detecting a crash for a model race car;

FIG. 9 sets forth a light activated sensor;

GENERAL DESCRIPTION

Discussion of Prior Art

Figure 1:
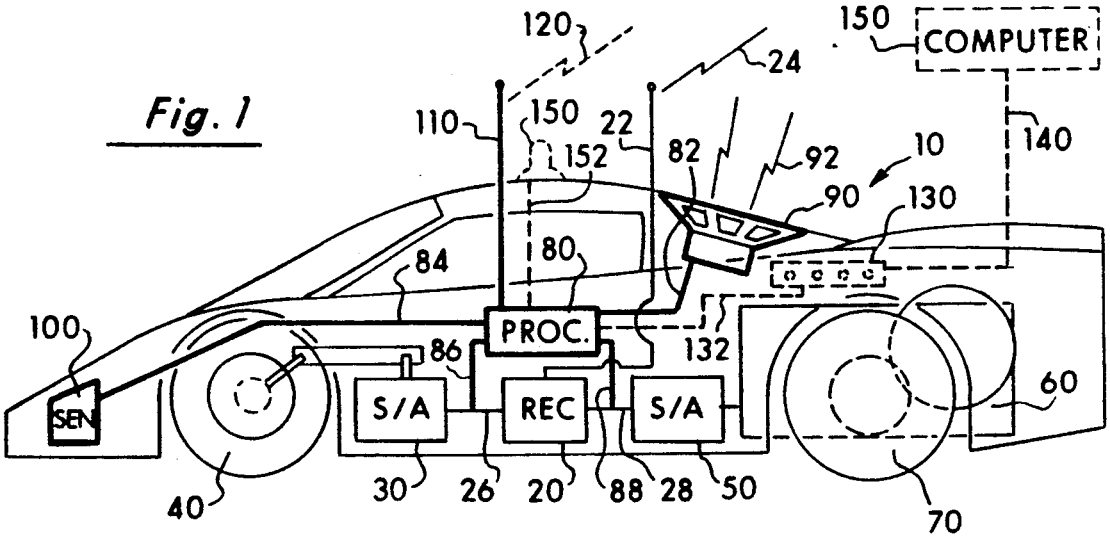
FIG. 1 is an illustration of a prior art radio controlled model vehicle modified to include the self-contained sound effects system of the present invention.
Figure 2:
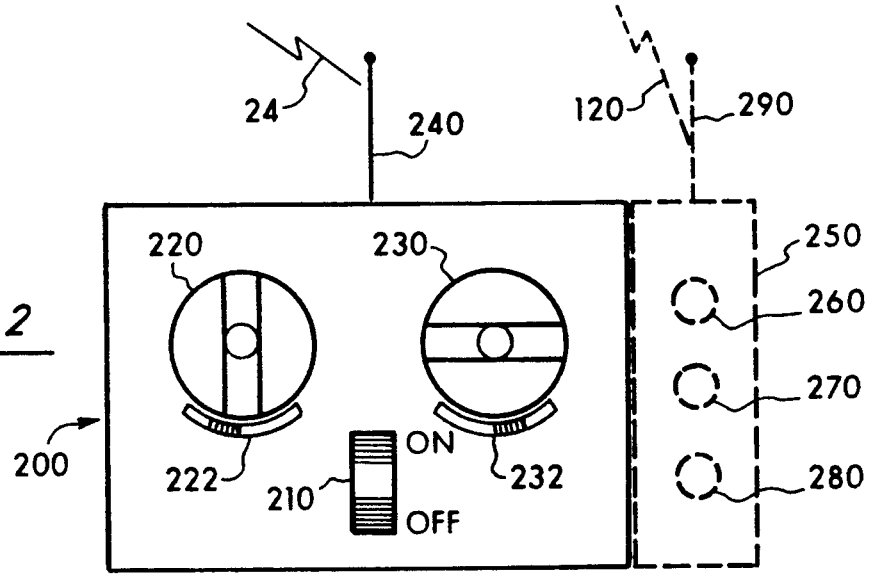
FIG. 2 sets forth a prior art remote radio transmitter for controlling the vehicle of FIG. 1 modified to include the asynchronous transmitter of the present invention.

FIGS. 1 and 2 set forth a prior art radio controlled model vehicle 10 and its associated remote radio transmitter 200, as modified under the teachings of the present invention.

The conventional model radio controlled vehicle 10 could, for example, be a model race car, model four-wheel drive off-the-road vehicle, a model boat, or a model airplane.

Some vehicles 10 typically contain, in the case of a model vehicle such as a car, a receiver/demodulator and signal processor 20 interconnected with an antenna 22 for receiving radio controlled signals 24. The receiver/demodulator 20 is interconnected over line 26 to a servo/actuator 30 which controls the wheels 40 to turn the vehicle left or right. The receiver also is interconnected to a servo/actuator 50 over line 28 which in turn is connected to a motor controller actuator 60 which provides power to the rear wheels 70 for moving the vehicle in the forward or reverse directions. It is to be expressly understood that in some designs, the servo/actuator 50 and the motor controller actuator 60 may be combined into a single electronic unit. Likewise it is to be expressly understood that the servo/actuator 30 could include a motor controller actuator when used in four-wheel drive environments.

While the present disclosure concentrates on modifying vehicles with pulse width modulation (PWM) control signals, it is to be expressly understood that other control types, such as direct current control could also be suitably modified. Furthermore, the present invention can associate appropriate sound effects with any number of servo/actuators present in the vehicle and is not limited to those shown in FIG. 1.

In FIG. 2, a conventional radio transmitter 200 is shown having an antenna 240 for delivery of electromagnetic radio signals 24 to antenna 22 of the vehicle 10. Transmitter 200 has an on/off switch 210, a control stick 220 for controlling the forward and reverse motion of the vehicle 10 and a control stick 230 for controlling the left and right turning of the vehicle 10. Calibration or adjustment of the vehicle is provided by controls 222 and 232. For example, control 232 allows the user to adjust the control signals in the vehicle so that the vehicle travels in a straight line when control 230 is in the center/resting position. Likewise, control 222 adjusts the movement for the control 220 in the center/resting position.

In operation, selective activation of control stick 220 when pushed in the forward direction delivers a signal over radio waves 24 to the antenna 22 which is received by the receiver/demodulator unit 20. The control signals selectively cause the units 50 and 60 to move the vehicle in the forward direction. The turning of the vehicle in the left or right directions is accomplished through the selective activation of control stick 230. This causes a second signal to be generated in radio signals 24 through antenna 22 to the receiver/-demodulator 20 which delivers a processed signal over line 26 to the forward servo/actuator 30 to cause the forward wheels 40 to turn left or right, respectively. This briefly describes the conventional operation of a model radio controlled vehicle. Other vehicles will have comparable sets of controls for activating conventional vehicle operations. For example, a speed boat will have rudder and motor controls, a helicopter may have a number of different controls, etc.

Modification of Conventional Vehicle

The conventional vehicle 10 is modified under the teachings of the present invention either as original equipment or as a retrofit to an existing radio controlled vehicle. The present invention can be delivered to an original equipment manufacturer and be built-in for retail sales as an integral part to a radio controlled vehicle or it may be sold as a kit for user modification or adaption of an existing radio controlled vehicle.

The present invention provides a fully self-contained system entirely resident on the vehicle which generates realistic sound effects as a coordinated part of the internal operation of the vehicle such as idle, driving and gunning motor sounds, acceleration, gear shifting, tire squealing sounds upon peel-out or sharp turning, and crash sounds. Optionally, the system includes the generating of asynchronous sounds, activated remotely such as "machine gun fire", "rocket launch", and "siren" sounds.

The present invention, in the self-contained system, utilizes a processing unit 80 which includes a central processing unit, an EPROM, a sound synthesizer, a digital-to-analog convertor and an amplifier. The processing unit 80 is interconnected over lines 82 to a speaker 90. Speaker 90 provides the various sound effects as taught by the present invention. The processing unit 80 is also interconnected over line 84 to one or more on-board sensors 100 which sense or detect the condition of the vehicle such as when the vehicle hits an object and crashes or tilts and rolls over. Sensor 100, for example, can comprise an accelerometer, motion sensor, etc. It is to be expressly understood that sensor 100, as will be discussed elsewhere, could sense an external stimulus directed to the vehicle such as a light sensor for detect incoming light or sound sensor for detecting an incoming sound wave.

The present invention, in the optional asynchronous mode of operation, is connected to an antenna 110 which is receptive of control signals from radio signals 120. This antenna 110 receives asynchronous sound effect control signals from a remote transmitter 250 as shown in FIG. 2 which are activated directly by a user (thus, asynchronously activated). Asynchronous signals are not related to the operation of the vehicle, the condition of the vehicle, or the presence of external stimulus (such as a siren sound).

In the event antenna 110 is utilized, it is to be expressly understood that the processing unit 80 further contains a suitable receiver/demodulator for transforming the radio control signals 120 into suitable electrical control signals. In FIG. 2, the optional transmitter 250 is shown attached to the side of a conventional transmitter 200. Control switches 260, 270, and 280 are provided for activation of the asynchronous sound effects. Upon activation of one of the switches, the antenna 290 transmits the radio control signal 120. It is to be expressly understood that the separate transmitter 250 can be made to retrofit to the side of a conventional transmitter 200, can be utilized separately and apart from transmitter 200, or in the case of original equipment, can be built into and be part of the conventional transmitter 200.

In operation, the vehicle 10, as modified by the teachings of the present invention, operates in the two basic modes. In the self-contained mode of operation, the antenna 110 and the transmitter 250 are not necessarily used. If the vehicle operates only in the self-contained mode, the antenna/transmitter would not be required. If the vehicle operates in both basic modes, then they would be required. In self-contained mode of operation, the processing unit 80 interconnects over lines 86 and 88 with conventional control lines 26 and 28. Hence, when the user of transmitter 200 moves the car in the forward direction through activation of control 220, the control signals from the receiver demodulator 20 which are delivered on line 28 are picked up by line 88 and delivered into the processing unit 80. In response to those signals, the processing unit 80 outputs an appropriate sound effect into speaker 90 to generate a sound 92. It is to be expressly understood under the teachings of the present invention that more than two such control lines (26 and 28), depending on the vehicle and the environment, could be utilized to coordinate and generate sound effects.

The following types of sounds can be generated. If the vehicle 10 is stationary and the control 220 is rapidly moved in the forward direction, the sound of squealing tires (i.e., PEELOUT) is generated by speaker 90. Likewise, once the vehicle is at a given speed, the roar of an engine sound (i.e., DRIVE) is delivered through speaker 90. When control 230 is activated to turn the car left or right, again, the receiver demodulator 20 delivers the appropriate conventional control signals over line 26 which are picked up on line 86 and the processing unit 80 of the present invention delivers the appropriate squealing-of-tires sound (i.e., SCREECH) through speaker 90 as the car turns either left or right. The timbre and pitch of the SCREECH is varied depending on the degree of the turn.

In the event that the vehicle hits an object, sensor 100 causes a signal to be delivered over line 84 into the processing unit 80 which delivers a crashing sound (i.e., CRASH) through speaker 90. As will be explained in the following, other transducers 100 and different sound effects can be created under the teachings of the present invention to create realistic sounds which are coordinated to the respective operations of the vehicle. In this mode of operation, the electronics of the present invention and the speaker are fully self-contained within the vehicle and there are no external transmission of control signals to or from vehicle 10, for the purpose of generating sound effects.

In the asynchronous mode of operation, the separate transmitter 250 is utilized as well as the antenna 110. In this mode of operation, a suitable receiver/demodulator is in the control processing circuit 80. These operations are asynchronous since they are not directly linked to the operation, condition or external stimulus of the vehicle 10 as described above. Special sound and visual effects such as the sound of machine guns; operation of headlights, turn signals, passing lights; horn rocket launchers; etc. can be activated by control signals transmitted to the antenna 110. In FIG. 1, an optional emergency light 150 is operated over line 152 from processor 80. The processing unit 80 generates the appropriate sounds in speaker 92. When the asynchronous mode of operation is provided as original circuitry, it is to be expressly understood that the separate antennas 110 and 290 can be eliminated since all transmission can be designed to occur between antennas 22 and 24.

Finally, an optional RS232 port 130 is interconnected over lines 132 to the processing unit 80. This port provides a convenient function for the user. It allows the vehicle 10 to be connected to a standard personal computer for custom modifying the sound effects to be generated. Through this port 130, the software for operation of the invention as well as sound data can also be modified. For example, if an additional sensor is added, new software can be loaded to respond to the additional sensors. This capability makes the vehicle entirely flexible—one which is programmable directly from an external computer 150 which is interconnected over cable 140 with port 130.

In addition, sound effects can be changed or tailored through use of computer 150. Hence, the use of computer 150 allows for fully programmable sound effects for a model vehicle. The sounds and how the sounds coordinate with the vehicle's operation can be programmed externally.

In summary, the present invention can be (1) self-contained (i.e., fully contained within a conventional vehicle wherein the sound effects are generated on board the vehicle in response to (a) internal control signals (i.e., turning right, gear shifting), (b) on board sensors responsive to a number of physical conditions of the vehicle (i.e., crash, roll-over), or (c) on board sensors responsive to a number of external stimulus directed towards said vehicle (i.e., a light, sound), (2) asynchronous (i.e., control for the sound effect is activated by the user remotely, or (3) self-contained and asynchronous. Also the present invention can be sold as an "add-on" kit to owners of such vehicles or "built-in" to new vehicles by a manufacturer as part of the original equipment.

DETAILED DESCRIPTION

Self-Contained Design

As mentioned, the self-contained design of the present invention provides for sound generation and control circuitry that are mounted entirely on-board the vehicle and which are capable of being actuated directly from the existing on-board conventional electronic control signals which are used to affect operation of the vehicle or which are activated directly from on-board sensors. In this mode of operation, the present invention generates realistic sound effects as an integral part of the operation of the vehicle by linking the sound effect generation to the electronic control of the vehicle (e.g., rapid acceleration or turning) or by linking the sound effect to any detected physical condition or external physical event (e.g., detecting a crash or an overturn).

The self-contained design is lightweight, rugged and enables the system of the present invention to rapidly respond to provide realistic sound effects actually coming from the vehicle.

Pick-up of Conventional Control Signals

Figure 3:
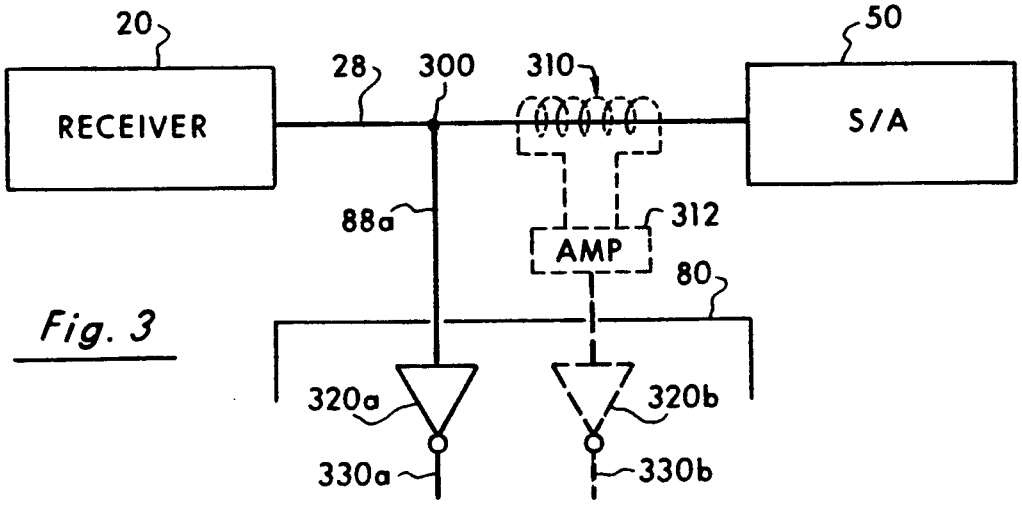
FIG. 3 is a schematic showing the electronic pick-up by the present invention of conventional internal control signals.

In FIG. 3, the conventional receiver/demodulator 20 interconnected with the conventional servo/actuator 50 over line 28 is shown. The present invention can either invasively, as shown by a hardwire connection 300, or non-invasively, as shown by a coil pick-up 310 and amplifier 312, detect the actual conventional control signals on line 28. Whether an invasive approach 300 or a non-invasive pick-up 310 is utilized, depends upon a number of considerations. In a original equipment situation where the present invention is built into the vehicle at the factory, the invasive 300 approach would be utilized. However, in the case of a retrofit to existing model radio controlled vehicles, the non-invasive pick-up 310 may be utilized so as not to void any warranty provided by the manufacturer. In either situation, the control signals on line 28 are delivered to lines **88*a* (for invasive) or 88*b*** (for non-invasive). One or the other interconnect will be utilized and, therefore, the non-invasive approach is shown in the dotted lines.

The detected signal is then delivered into a signal buffer 320 which buffers (such as through use of an invertor) the detected signal for delivery onto lines 330. The buffers 320 reside on the processing unit 80.

Likewise, a similar invasive or non-invasive pick-up exists between the receiver 20 and the servo/actuator 30 which controls the turning of the wheels.

Furthermore, the signals, in the case of a design built into a vehicle at the factory, could be generated simultaneously by separate circuitry operative with the vehicle control signals. For example, receiver 20 could be designed to output two simultaneous signals.

It is to be expressly understood that any suitable design for detecting the conventional control signals, such as discussed in the next section, could be utilized under the teachings of the present invention. Also, the present invention could use separate transducers to monitor operation of the vehicle (rather than use of the internal control signals) such as motion sensors and the like. While this approach adds to the cost of the system and while this approach is not as responsive as sensing actual control signals, it does represent an alternate embodiment under the teachings of the present invention.

The goal in the self-contained design discussed herein is to sense the conventional control signals and, then, to generate coordinated and realistic vehicle sounds based upon the status of such control signals. In other words, the user of the conventional transmitter 200 simply operates the transmitter 200 in a conventional fashion and the realistic sounds are automatically generated.

Detection of Conventional Vehicle Control Signals

In FIG. 4 are shown conventional control pulses between the receiver 20 and the servo/actuator 50 on line 28. This represents a typical control pattern existing in the more expensive model radio controlled vehicles. The pulse frequency is stable. The center resting/pulse 400 typically has a known width. For example, some vehicles have a pulse frequency of 60 Hz with a pulse width of 0.9–1.0 msecs. This pulse is normally calibrated by the user one or more times during use with suitable controls on the transmitter 200. The lengthening or shortening of pulse 400 as shown by pulses 410 and 420 controls the operation of the vehicle. The change in pulse width is typically ±50% (or about ±0.4 msecs). It is to be expressly understood that the invention will work with all electronic control signals in model vehicles, of which the above is a typical example. For example, when the drive motor is being controlled, pulse 410 causes the vehicle to move in the forward direction. Likewise, pulse 420 which is a shortening of pulse 400 causes the vehicle to move in the reverse direction. It is to be expressly understood that pulses 410 and 420 could be reversed in that 410 could cause the reverse motion and 420 could cause the forward motion. In addition, the same technique for pulse control is utilized for turning the vehicle left or right (i.e., shortening of the center pulse causes the vehicle to turn right and lengthening of the center pulse causes the vehicle to turn left). The sharpness of the turn (or degree of acceleration) depends on the degree of lengthening or shortening. It is these pulses that the processing unit 80, of the present invention, as shown in FIG. 1, receive over lines 86 and 88 to produce the desired sound effects under the teachings of the present invention.

For example, when the pulses of FIG. 4 are used to turn the vehicle left or right, the center pulse 400 causes the vehicle to go straight. Pulse 410 could cause the vehicle to turn left and pulse 420 could cause the vehicle to turn right. (Again, the sense of direction can be reversed.)

In mass marketed, less expensive model radio controlled vehicles the control signals for turning and moving may be simple on/off signals (i.e., full forward, full left). In such cases, the present invention detects such on/off states and generates sound accordingly.

Conventional on-board control signals in other radio controlled vehicles could include, for example, gun turret controls in tanks, rudder controls in boats, etc. The teachings of the present invention are adaptable to these different types of control signal environments through use of a suitable invasive or non-invasive pick-up as discussed above.

Coordinating Sound Effects With Processing Unit 80

In FIG. 5 the details of the processing unit 80 are shown. The processing unit 80 includes a microprocessor 500, an EPROM 510 (electrically programmable read only memory) 510, an oscillator 520, a power-up chip 530, a serial port 540, a digital-to-analog converter 550, a sound synthesizer 560 and the buffers 320. Optionally, for the asynchronous mode of operation, a receiver/demodulator circuit 570 can be provided.

In the preferred embodiment, the microprocessor 500 is a general purpose microprocessor controller which is programmed and connected under the teachings of the present invention. In the preferred embodiment, a Motorola MC 68HCll is utilized which is available from Motorola Center, 1303 E. Algonquin Road Schaumburg, Ill. 60196. The microprocessor 500 is interconnected over lines 502 to EPROM 510 which is the computer memory for all the programs necessary to coordinate the sound effects with the internal control signals, the sensed vehicle condition, any sensed external stimulus, or any asynchronous commands. EPROM 510 may also store some of the stored sound data necessary to create the sound effect. In the preferred embodiment, an Advanced Micro Device Model 27512,64K CMOS EPROM is used which is available from 901 Thompson Place, Sunnyvale, Calif. 94088. It is to be expressly understood that other conventional types of digital memory, such as a ROM or an EEPROM could be utilized.

The microprocessor 500 is also interconnected to the oscillator 520 over lines 504. In the preferred embodiment, the oscillator is 8 MHz such as Part P5C-2 from Fox Electronics, 5842 Corporation Circle, Fort Meyers, Fla. 33905.

The microprocessor 500 is further interconnected over line 506 to the power-up chip which in the preferred embodiment is a model 33068 manufactured by Motorola. The microprocessor 500 is interconnected over lines 508 to a serial port 540. The serial port is a model MAX232 manufactured by MAXIM, 120 San Gabriel Drive, Sunnyvale, Calif. 94086. The serial port 540 allows the operator of the present invention to change or add to both the stored programs and the stored sound data—such as in the case of adding a new sensor 100.

The microprocessor is also interconnected over lines 512 to the digital-to-analog (D/A) converter 550 and optionally to a sound synthesizer 560 over line 514. The sound synthesizer can either be connected over line **562*a* to D/A converter 550 or over 562*b* to amplifier 580. Finally, an audio amplifier 580 is interconnected to the D/A converter 550 over line 552. The amplifier in turn is connected over line 82 to the speaker 90**.

The optional sound synthesizer 560 is an electronic circuit which contains oscillators that generate sign, sawtooth and square wave forms under control of the microprocessor 500. The oscillator signals in the sound synthesizer 560 can be frequency controlled, modulated, filtered, adjusted for amplitude, fed through an envelope generator and mixed together. This occurs under microprocessor control. In this fashion, a particular sound such as motor running noise can be adjusted in pitch, timbre, amplitude and frequency to become higher pitched and louder as the operator more quickly moves control 220 (i e., the faster the pulse width 410 changes). The output on line **562*a* is a digital signal whereas the output on line 562*b* is analog. In the preferred embodiment, the optional sound synthesizer 560 is a general purpose synthesizer such as the Commodore 6581 SID chip available from Commodore Business Machines, 1200 Wilson Drive, West Chester, Pa. 19380. The D/A converter 550 converts the eight bit digital signal on lines 512 (and/or 562*a*) to an analog signal on line 552 for delivery into amplifier 580**.

Figure 10:
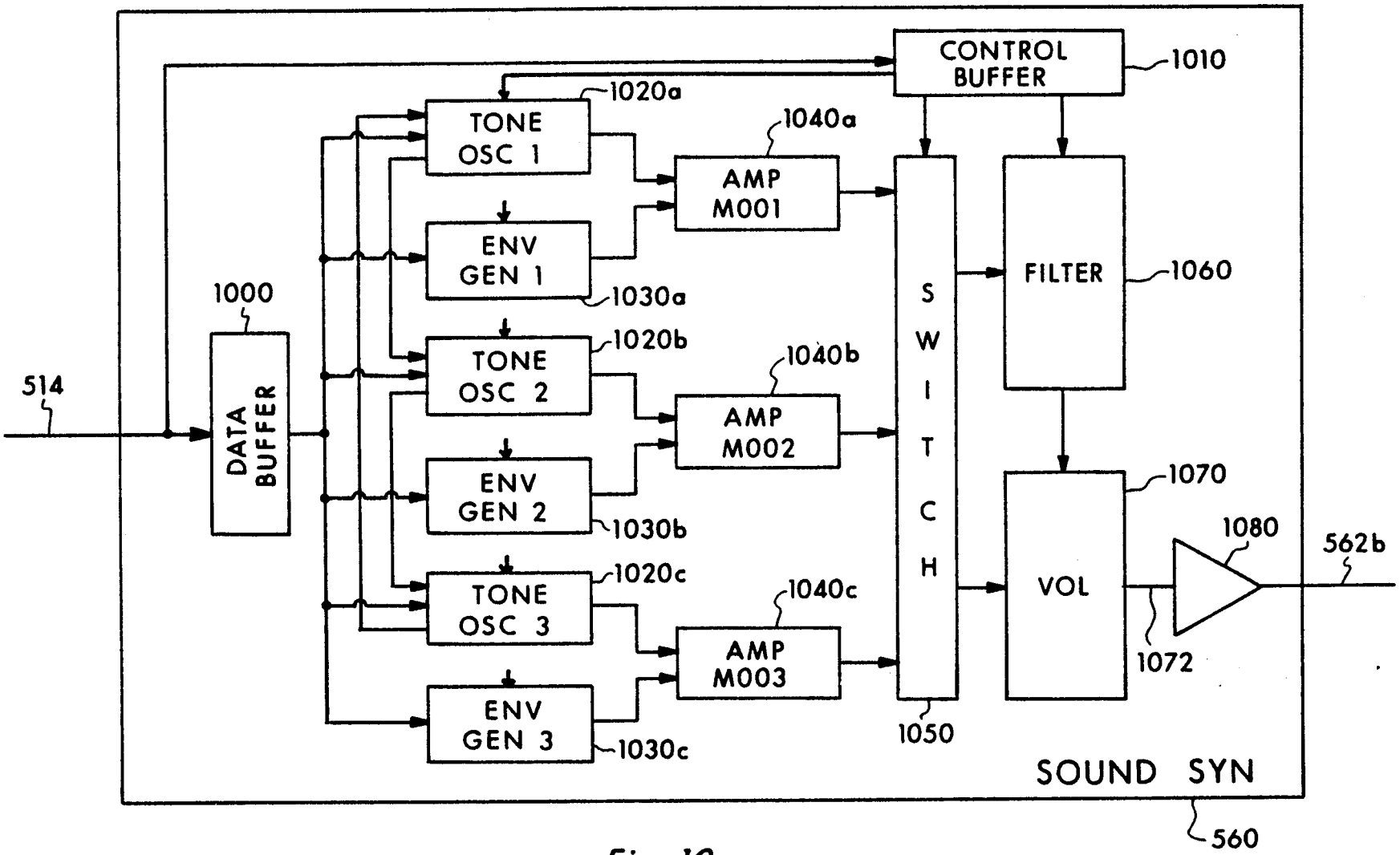
FIG. 10 sets forth the block diagram details of an optional synthesizer chip.

The use of a sound synthesizer 560 for delivering an analog signal over line **562*a* is shown in FIG. 10. The data and control signals over bus 514 from the microprocessor 500 are delivered to a data buffer 1000 and to a control buffer 1010. The data buffer 1000 is interconnected to a number of tone oscillator 1020 and envelope generator 1030 combinations. The tone oscillators can generate square waves, sign waves, sawtooth, etc. whereas the envelope generators generate the particular amplitude for the noise produced by the oscillator. The envelope adjusts the amplitude of the noise over time. The outputs of the tone oscillator 1020 and the envelope generator 1030 are delivered into an amplitude modulator 1040 for combining the sound into the envelope. The control buffer 1010 under command of the microprocessor activates switch 1050 to selectively combine the outputs of the amplitude modulators 1040 together to produce the desired sound combinations. The control buffer 1010 also controls a filter 1060 for filtering out frequency over time. The output of the filter 1060 is delivered into a volume circuit 1070 which provides an analog output on line 1072 into an amplifier 1080. The circuit in FIG. 10, shows the use of an optional sound synthesizer chip wherein the sound effects for the vehicle are delivered with simple tone oscillator circuits 1020 and simple envelope generators 1030. The processing software from the microprocessor, however, is complex. Hence, in this approach, the microprocessor (and EPROM 510) must have sufficient memory to store the complex processing necessary to reconstruct the sound data which is delivered in an analog form over line 562***b*.

Optionally, a digital synthesizer 560 could be utilized which would deliver digital sound signals to converter 590 over line 562*a*.

Figure 11:
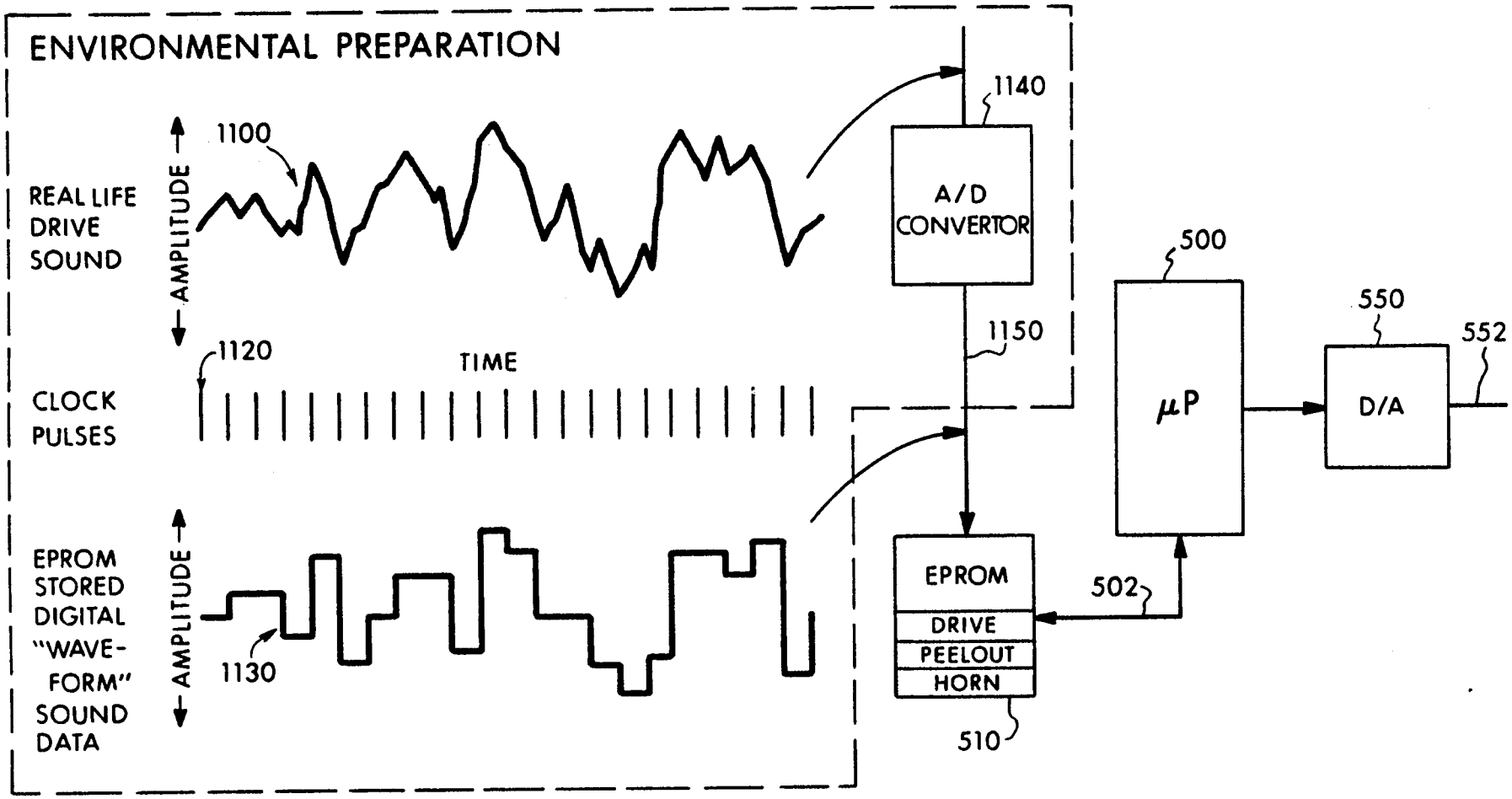
FIG. 11 sets forth the block diagram details for the use of digitally stored sound data.

In FIG. 11, the processing unit 80 of the present invention without the optional sound synthesizer chip 560 is shown. In this approach, sound data is stored in the EPROM 510 or in the internal memory of the microprocessor 500. In this approach, memory must be provided for the sound data, but the processing software is less complex. In FIG. 11, a real life sound 1100 is recorded. The real life sound could, for example, be engine noise as is shown in FIG. 11 by curve 1100. The realistic sound 1100 is digitized according to a set of clock pulses 1120. The digital version is represented by curve 1130. For example, an analog to digital converter circuit 1140 receives the realistic sound 1100 and converts it into the digital version 1130 for storage into the EPROM 510 such as by means of connection 1150. This occurs either at the manufacturer of the present invention or through user modification such as through serial port 540. In the EPROM 510, segments of sounds such as DRIVE, PEELOUT, HORN, etc. are stored for delivery over line 502 to microprocessor 500 which in turn delivers the digital sound to a D/A converter 550 for reconstruction into a realistic sound effect.

It is to be expressly understood that the sound data delivery shown in FIG. 5 can be suitably modified without departing from the spirit of the present invention. For example, the system can be designed so that all sound data is delivered from the EPROM (FIG. 11), all sound data is delivered from the synthesizer chip (FIG. 10), or a mixture between the two approaches. Further, all such features can be programmed into a suitably designed microprocessor chip.

The audio amplifier 580 amplifies the analog sound signal on line 552 and drives the speaker 90 over line 82. In the preferred embodiment, a conventional 386 audio amplifier is utilized but, it is to be expressly understood that a simple FET or bipolar device audio amplifier could also be utilized.

The speaker 90 provides the sound 92 output and, in the preferred embodiment, is a two inch diameter high output speaker having a plastic cone. The speaker is of compact design, lightweight, and water resistant with excellent relative power output. Depending upon the application, more than one speaker 90 could be utilized to more evenly distribute sound power in different directions.

It is to be expressly understood that the essential electronic components of FIG. 5 could be fabricated into one or two specialized micro-chips for greater compactness, low cost, reduced power, consumption, and for less weight.

An optional receiver/demodulator circuit 570 could be utilized in the asynchronous mode of operation. The antenna 110 receives the asynchronous radio signals 120 from the remote transmitter and the receiver/demodulator circuit 570 receives and demodulates the signal. The output of the receiver/demodulator circuit 570 is delivered on line 572 to one of the input ports of the microprocessor 500 through buffer 320.

The microprocessor 500 receives operation control signals over bus 330 from the buffer 320. For example, the forward and reverse control signals are delivered on line 88, left or right turn signals are delivered on line 86, and the CRASH sensor control signals are delivered on line 84. Any number of control signal inputs can be delivered to microprocessor 500 through the buffers 320.

It is to be expressly understood that the design of FIG. 5 represents one of many possible designs that can function according to the teachings of the present invention. The type of synthesizer, the size of the digital memory and whether or not an external serial port is used are examples of design variations under the system of the present invention.

Operation of Present Invention

In operation, based upon the control signal inputs 330 (and in the optional environment, the received and demodulated signals on line 572), the microprocessor 500 is programmed to make decisions as to the current physical situation or status of the vehicle 10. For example, microprocessor 500 determines when rapid acceleration occurs to generate a "PEELOUT" sound effect or when the vehicle 10 is normally accelerating in order to cause an increase in the motor DRIVE sound. In the event the microprocessor 500 receives a control signal over line 84 (indicative, for example, of a crash), the microprocessor 500 interrupts the current sound effect to generate a "CRASH" sound which overrides the current sound effect. This is a form of sound coordination. In addition, if an asynchronous sound signal is received by antenna 110 and a control signal is delivered over line 572, the microprocessor may override the current sound effect. For example, if the current sound effect is the motor DRIVE sound and the user of the remote transmitter 250 activates a "machine gun" sound effect, the machine gun sound would override the motor DRIVE sound effect. This is another form of sound coordination. The present invention is capable of mixing sounds, for example, the DRIVE sound can be mixed with the SQUEAL upon turning. This is also a form of sound coordination as taught by the present invention.

Figure 6:
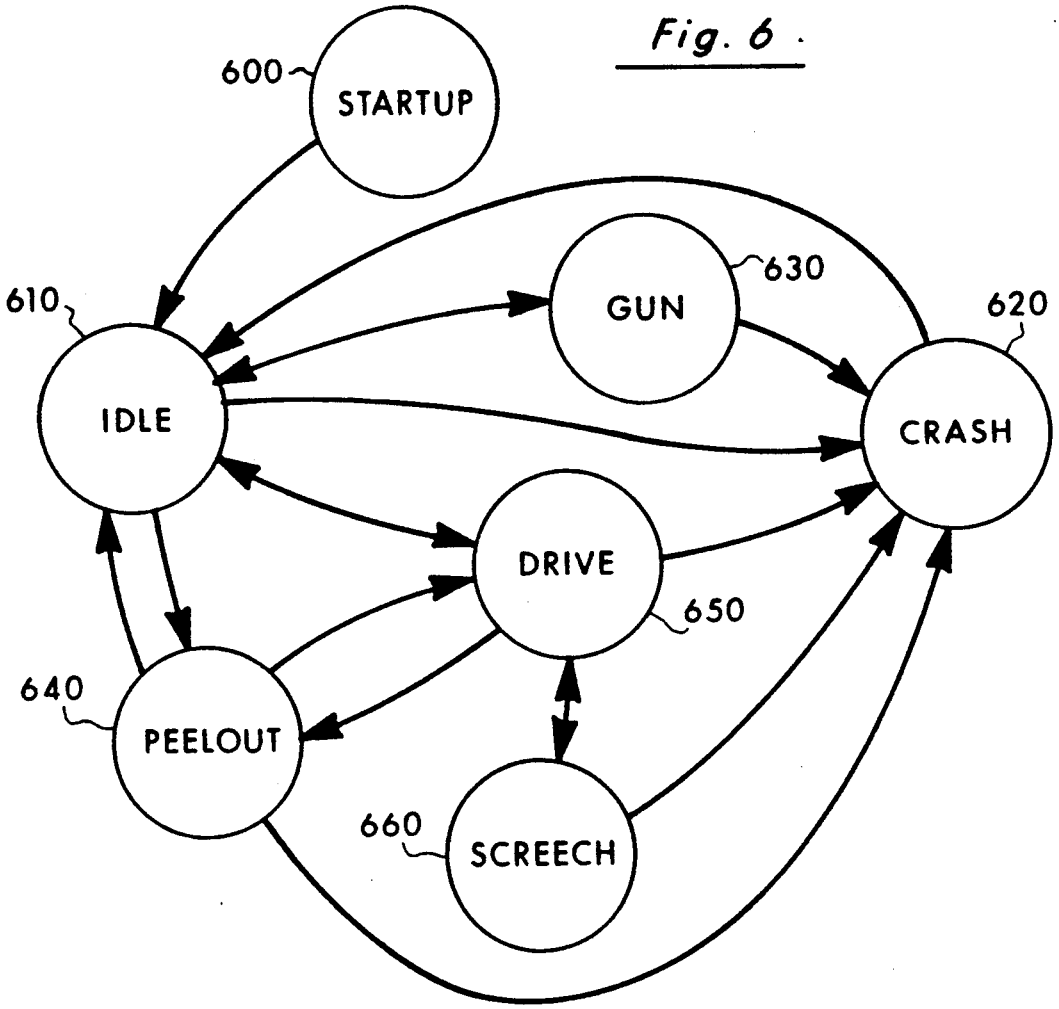
FIG. 6 sets forth the state table operation of the present invention for the example of a model race car.

In FIG. 6, an example of a state table approach to the operation of the present invention is set forth. It is to be expressly understood that variations to this approach could be made from vehicle to vehicle, from type of sensor to type of sensor and upon the type of sound effect desired. What follows is an example of state table for a self-contained system of the present invention designed for a vehicle having wheels such as a race car. The program for the state table operation is stored in EPROM 510. The sounds being generated in this example are: Motor sounds: IDLE, GUNNING, DRIVE; tire sounds: PEELOUT, SCREECH and crash sounds: CRASH. The GUNNING sound is asynchronously activated—that is, the operator can activate a button 260 to asynchronously "gun" the engine of the car.

In FIG. 6, when the vehicle 10 is turned on by the operator, the STARTUP process 600 is entered. Typically the user of the present invention, as mentioned, calibrates the vehicle through adjustment of the center resting/pulse 400 (FIG. 4). The microprocessor 500 receives the center/resting pulses 400 over line 86 or 88 and averages a predetermined number (in the preferred embodiment 6 pulses) to obtain an averaged "center" pulse as being representative of a true center pulse width. In fact, the present invention performs a continuous running average of pulses, during operation, to filter out spurious pulses, noise, etc. For example, when a model vehicle is operated near a 60 Hz power source, spurious pulses can be picked up. It is important to screen out random fluctuations and other noise.

The IDLE state 610 is then entered and an IDLE sound 92 is generated indicative of a motor idling. The microprocessor 500 generates control signals over leads 512 and 514 to cause the sound synthesizer 560 and the digital analog converter 550 to generate a motor "IDLE" sound in speaker 90. The microprocessor 500 maintains the IDLE sound when the forward 410 and reverse 420 pulses are close to the center pulse 400 (i.e., less than some delta t as shown in FIG. 7).

Figure 7:
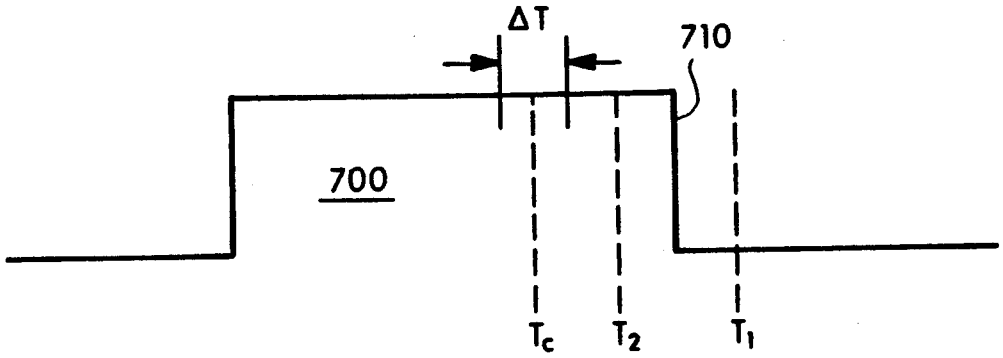
FIG. 7 sets forth the analysis of the leading edge movement of the control pulses of FIG. 4.

In FIG. 7, the averaged center pulse 700 is shown. When the edge 710 of the pulse 700 is at time $T_c$, the pulse is centered as determined through the aforesaid averaging technique. When the edge 710 of the pulse 700 rapidly moves and exceeds a point at time $T_1$ the PEELOUT process 640 is entered. The microprocessor 500 determines the rate of time it takes the edge 710 to move past time $T_1$ and if the rate of change exceeds a predetermined value, stage 640 is entered and a PEELOUT sound is generated in speaker 90. In the event that the rate of change is below the predetermined value, DRIVE state 650 is entered. In other words, the microprocessor 500 determines the rate at which the edge 710 travels past $T_1$ and if it is above a certain rate the PEELOUT process 640 is entered and if below that rate the DRIVE state 650 is entered. In the DRIVE state, a "driving motor" sound will be generated in the speaker 90.

The microprocessor, as with the center pulse averaging, also takes a running average of a predetermined number of pulses in determining the position of edge 710 in order to screen out random fluctuations and other noise.

If the PEELOUT process 640 is entered from stage 610, the DRIVE state 650 can also be entered from the PEELOUT process 640 when the rate of change drops below the predetermined value $T_1$ or at the end of the PEELOUT sound sequence. Hence, the operator of the conventional control 200 in moving the control stick 220 rapidly or slowly determines whether or not the car will generate a PEELOUT sound or a normal DRIVE sound. The DRIVE sound for a driving motor is varied in pitch and timbre with the width of pulse 700 so that the DRIVE sound represents realistic motor sounds over the full range of speeds. Pitch, loudness and timbre can vary according to the width of the pulse 400 with the rate of change. If a PEELOUT sound is generated, it plays to completion unless interrupted by a CRASH. Hence, the vehicle 10 realistically generates sounds based upon the performance of the car as in real life. When PEELOUT is completed the system enters the IDLE or DRIVE state depending on the width of the control pulse.

In reference to FIG. 6, the IDLE state enters the DRIVE state 650 in the event of slow acceleration and enters the PEELOUT process 640 in the event of quick acceleration. In the PEELOUT process 640, the present invention can enter the DRIVE state 650 upon slowing the acceleration of the vehicle 10. In addition, if the vehicle is in the PEELOUT process 640, the IDLE state 610 can be reentered if the edge 710 is less than time $T_2$. In other words, the user has moved the control stick 220 to a position which idles the vehicle and, therefore, an IDLE sound is generated.

The GUN process 630 is asynchronously initiated at the discretion of the operator from the remote transmitter 250 through operation of one of the switches, for example, 260. Engine gunning sounds may be initiated from the IDLE state 610 and upon completion of the gunning initiation, the system returns to the IDLE state 610. However, the GUN process 630 can be interrupted by a signal from sensor 100 and hence, would enter the CRASH process 620. After CRASH 620, the system returns to the IDLE state 610.

In normal operation, the system START-UP 600, enters the IDLE state 610, and the user slowly moves the control stick 220 to enter the DRIVE state 650. The pitch of the DRIVE sound varies according to the width of pulse 400. From the DRIVE state 650, a CRASH 620 can occur in which the system would return to the IDLE state 610, a PEELOUT 640 from the DRIVE 650 can occur based upon a rapid acceleration (i.e., whenever edge 710 has dropped below $T_1$), and hence, the PEELOUT state 640 could be entered, or a SCREECH 660 can occur through activation of the left or right control signal appearing on line 26.

When this occurs, stage 660 is entered and the appropriate "SCREECH" sound is generated in speaker 90. The amplitude and frequency of the "SCREECH" sound can be modified dependent upon how rapidly the user operates the control stick 230 to turn the car right or left. As before with PEELOUT and DRIVE the "SCREECH" sound is affected by how rapidly the edge 710 moves. A more rapid movement of edge 710 causes a higher amplitude and a higher frequency SCREECH whereas the slower movement of edge 710 would cause a lower amplitude and lower frequency SCREECH. Again, this realistically emulates the sound of a real vehicle.

In the preferred embodiment, the current invention processes control pulses from several aspects:

(1) it averages six pulses to obtain a true "center" of "rest" state pulse width. This value is stored for reference and may be redone at anytime at the discretion of operator during normal recalibration of vehicle.

(2) it keeps a running average of each "channel's" control pulses. This is done to filter out spurious pulses or noise.

(3) it takes certain actions or maintains certain operating states based on current pulse width, such states being selected based on preset, software, adjustable thresholds. For example, when a Forward/Reverse (F/R) pulse width is within a certain range, the vehicle is in "IDLE" state. When the F/R pulse width is outside this range, and a "delta pulse width/delta t" is slow or modest, the vehicle is in the DRIVE state. In DRIVE, the pitch and timbre of sound effects are directly related to the current pulse width.

(4) It responds to a "delta pulse width/delta t" which is greater than a preset software adjustable value, and is positive (accelerating, F or R), and when the "delta pulse width/delta t" was initiated from within a certain threshold pulse width (that is, acceleration from a slow initial speed), then a PEELOUT sequence is initiated.

In a direct DRIVE control system (mass produced vehicle having on/off type control signals), a simple solenoid device is normally used for "all or none" steering and current to the solenoid is provided by a driver transistor(s). The motor is also driven directly usually with two sets of driver transistors one for the forward motion and one for the reverse direction. In such direct DRIVE control vehicles, the present invention utilizes the control signals present at the respective drive transistors.

It is expressly noted that other types of internal control signals for vehicles other than the pulse width modulation shown in FIG. 7 and the direct drive, discussed above, can be detected under the teachings of the present invention and utilized to control the creation of sound effects as specifically taught herein. Furthermore, the present invention can be utilized with more (or less) than two sets of vehicle control signals. In simple model radio control vehicles, only one channel may be utilized and in more sophisticated systems four or more control channels may be utilized. Hence, the present invention is not limited to a specific number of control channels.

Sensors 100

It is to be expressly understood that a number of different types of sensors 100 could be utilized. The sensor 100 in FIG. 1 is positioned to detect crashes. An elaboration of that approach is shown in FIG. 8 wherein sensor 100*a* and sensor 100*b* are both used to trigger entry into the CRASH process 620 of FIG. 6 through delivery of an interrupt signal on line 84 into the microprocessor 500 of FIG. 5. For example, sensor 100 which is a contact sensor having a weight 800 connected to a beam 810 for selectively making contact to contact 820 which is connected to ground in the presence of a force 830 on the front of the vehicle. When the vehicle carrying the sensor 100 encounters the force 830, weighted contact 800 makes electrical connection with contact 820 causing a pulse to be generated on line 840 for delivery into invertor 320 which generates the interrupt signal on line 84. In addition, a roll-over detector 100*b* comprising a container 850 holding a fluid such as mercury 860 utilizes two downwardly extending contacts 870 and 880. When the car turns in the direction of arrow 890, the mercury 860 makes contact with contacts 870 and 880 to generate a signal on line 884. A resistor 892 such as 100 Kilohms is connected to a positive voltage source. Hence, when either sensor 100*a* or sensor 100*b* is connected to ground a voltage drop occurs at the input of invertor 300 creating a signal on lead 84. The sensors 100 shown in FIG. 8 are set forth merely for purposes of example and it is to be understood that a large number of conventionally available sensors could be utilized under the teachings of the present invention to detect the presence of CRASH.

However, the invention is not so limited. For example, assume the vehicle 10 is a tank or other military vehicle. A sensor 100*c* is mounted on the exterior surface of the vehicle. Sensor 100*c* is a photocell which upon the presence of an activation light 900 causes the photocell 100*c* to turn on. This causes current to flow in line 910 thereby creating a voltage drop to the input of invertor 320 and causing an output on line 920. Line 920 could be, for example, the input to one of the buffers 320 as shown in the buffers 320 of FIG. 5. This particular embodiment now allows one person who is operating the transmitter of the remote control vehicle to play a game with another person utilizing a gun 930 or other object that produces a beam of light 900. Hence, when the second player of the game (or another vehicle) issues a beam of light 900 (i.e., an external stimulus), photocell detector 100*c* interrupts the microprocessor 500 to generate a suitable sound effect such as the sound of an explosion.

Sensors 100 may include touch, motion, acceleration, linear displacement, light, heat, and pressure sensors. Sensor technology may include buttons and other contact switches, mercury switches, magnet/coil, pendulum/beam, tilt switches; Piezo and other capacitive or thin film SI Wheatstone bridges; string gauges, resistive sweepers, Hall effects, detectors, IR and other frequency/light sensors, thermal couples, pressure transducers, etc.

Such sensors may be used to detect a variety of physical situations of the vehicle during its operation. The detected signals from such sensors, as discussed above, are sent to the microprocessor 500 through a suitable buffer 320 which are then used as the basis for the microprocessor to generate the appropriate sound effect related to the detected situation.

Sound Effects Generation

Two types of sound generation can be utilized. Both are conventional approaches.

In the first type of sound generation, a variety of real sound effects are recorded on analog tape. The sound effects, as recorded, are then digitized and analyzed using Fourier techniques.

Under the first approach, digitized sound data segments representing a variety of sound effects are edited and stored in the (erasable) read/only memory 510 (EPROM if computer 150 is used). The sound data is stored as short segments which can be randomly accessed, adjusted for pitch, timbre, loudness, duration and mixed together (if necessary) all under control of the microprocessor 500. It is important to recognize that memory space is a premium and the amount of memory space must be minimized both for cost and compactness. Therefore, only selected parts of the digitized sound effects are edited and stored in ROM 510 (EPROM if computer 150 is used). Pre-editing and specific sound expressions software utilized by the microprocessor 500 then allows the sound data to be compressed. The specific sound segments can then be broadly utilized such as looping through a short segment to create a longer real time sound or mixing several segments to create a different sound which sounds realistic but has no disturbing discontinuities. Such an approach creates realistic sound effects with a minimum use of digital storage. The software for the microprocessor 500 controls the selection and expression of the stored sound data and this software is stored in the microprocessor memory.

In a second approach, the analysis of the stored digital sound effects is used to design software which is then used by the microprocessor to control the digital sound effects synthesis circuitry (DSES) such as synthesizer 560. In controlling the DSES, the microprocessor 500 can randomly generate a wide variety of sound effects in real-time which can be varied in their timbre, pitch, amplitude and duration and which can be mixed together. The DSES contains square wave and sawtooth wave oscillators whose amplitudes and frequencies can be continuously modified, the output of one oscillator can be used to modulate the signal of another, signals from oscillators can be mixed, signals from oscillators can be filtered, routed through envelope generators and amplified. The control the DSES is through software stored in the ROM of the microprocessor 500.

In the present invention, these two approaches are both utilized.

Summary

It can be seen that the on-board processing unit 80 of the present invention is capable of monitoring normal model radio control vehicle electronic control signals for motion (such as, forward, reverse, and turning) either in the form as on/off type signals or proportional control type signals and is further capable of direct or proportional control of sound effects by selecting the appropriate type of sound effects for the situation and then varying pitch, timbre, loudness and duration to match the operation of the vehicle. The processing unit 80 is further capable of monitoring inputs from various sensors 100 on-board and utilizing this information in coordination with the information from the electronic control signals to create appropriate sound effects based upon a decision making program (such as that set forth in FIG. 6). The processing unit 80 is further capable of monitoring signals from an on-board RF receiver/-demodulator 570 in order to create sound effects on-board the vehicle in response to control signals asynchronously transmitted. The generation of such asynchronous control signals allows activity such as, engine gunning sound as desired while the vehicle is stationary, firing weapon sounds, boat horn sounds, etc.

The processing unit 80 receives its input from (1) on-board operation control signals, (2) on-board detection devices, and (3) on-board RF remotely controlled sound effects. The processing unit 80 analyzes these inputs and responds by causing the on-board sound effects from the sound synthesizer 560 and the D/A converter 552 to respond with the appropriate sound effect. The appropriate sound effect may be a mixture of several types of effects, and these effects may be altered as to pitch, timbre, loudness, and duration to suit the situation.

In summary, and as explained above with respect to FIGS. 5 and 6, when a radio control model vehicle such as a race car incorporates the present invention, the user activates the car and when the car is turned on, the vehicle is sitting still, but emitting a low irregular idle sound. The operator then causes the vehicle to emit engine revving noises by pushing a button (such as button 260 on transmitter 250). When the operator quickly accelerates the vehicle to activate the position of control stick 220, the vehicle emits a PEELOUT noise with rapid acceleration motor noise and the accompanying gear shifting noise. While driving along at a continuous speed, a continuous engine noise is emitted from the vehicle. The main frequency of this noise is adjusted to the speed of the vehicle. A rapid slowing of the vehicle through activation of control stick 220 is accompanied by the corresponding down shift and engine gunning noises. When the vehicle is directed by the operator through activation of control stick 230 to turn, tire squealing sounds are emitted and these are adjusted in frequency and loudness relative to the degree of turning. Should the vehicle hit a large object or turn over, a CRASH sound is emitted.

In the event the vehicle is an army vehicle such as a tank, other noises such as the sound of the moving treads are emitted. War sounds can also be emitted when simulating the firing of a gun or canon. A light sensitive sensor on the army vehicle can detect when the vehicle has been "hit" by the fire of another vehicle and appropriate sound effects that emit an explosion sound are generated.

It is to be expressly understood that the above summarizes a preferred embodiment as set forth in the text and drawings, other similar patterns of sound effects can realistically be created for model boats, model airplanes, etc. Although representative types of sounds have been discussed for vehicles, many other types of sounds can be generated on board the vehicle— for example: horn, firearms, anti-aircraft, water, jet noise, lawn mower, rain, thunder, traffic, trucks, tool noises (i.e., sander, saw, hammer, etc.).

It is to be expressly understood that the claimed invention is not to be limited to the description of the preferred embodiment but encompasses other modifications and alterations within the scope and spirit of the inventive concept.

I claim:

1. A self-contained sound effects system for a model radio controlled toy vehicle, said toy vehicle having a remote transmitter for transmitting radio signals through air to said toy vehicle, said transmitted radio signals comprising one or a plurality of internal control signals for the operation of said toy vehicle, said self-contained system comprising:

means located in said toy vehicle and receptive of said transmitted radio signals for detecting said internal control signals, means located in said toy vehicle and connected to said detecting means for generating sound data coordinated with said detected internal control signals, said generating means comprising:

a. means for delivering sound data corresponding to a plurality of predetermined realistic sounds for said toy vehicle, b. means receptive of said detected internal control signals from said detecting means and of said sound data from said sound data delivering means for outputting sound data coordinated with said detected internal control signals, and means located in said toy vehicle and receptive of said outputted sound data from said generating means for producing a realistic sound corresponding to said sound data.

2. The self-contained system of claim 1 wherein said sound data delivering means includes a sound synthesizer.

3. The self-contained system of claim 1 further comprising means located in said toy vehicle for sensing at least one physical condition of said toy vehicle, said generating means being responsive to said sensed physical condition for outputting sound data coordinated with said sensed physical condition.

4. The self-contained system of claim 3 wherein said sensing means is a sensor located on said toy vehicle for sensing when said toy vehicle strikes an object thereby activating said generating means to output a crash sound.

5. The self-contained system of claim 3 wherein said sensing means is a sensor located on said toy vehicle for sensing when said toy vehicle rolls over thereby activating said generating means to output a crash sound.

6. The self-contained system of claim 3 wherein said sensing means is a sensor located on said toy vehicle for sensing when said toy vehicle turns too quickly thereby activating said generating means to output a crash sound.

7. The self-contained system of claim 1 further comprising means located in said toy vehicle for sensing the presence of at least one external stimulus directed towards said toy vehicle, said generating means being responsive to said sensed external stimulus for outputting sound data coordinated with said sensed external stimulus.

8. The self-contained system of claim 1 further comprising means remote from said toy vehicle for delivering asynchronous sound effect signals to said generating means and means in said generating means receiving said asynchronous sound effect signals for outputting sound data corresponding to said asynchronous sound effect signals.

9. The self-contained system of claim 1 wherein said generating means modifies said sound data in response to changes in said detected internal control signals.

10. The self-contained system of claim 9 wherein said sound modification includes changing the pitch, timbre, or amplitude, of said sound.

11. The self-contained system of claim 1 further comprising a communications port connected to said generating means and a remote computer selectively engaging said communications port for changing the contents of said sound data.

12. The self-contained system of claim 1 further comprising means located on said computer for performing a physical function on said toy vehicle.

13. The self-contained system of claim 1 wherein said generating means averages a predetermined number of said internal control pulses in order to minimize the presence of noise and spurious pulses.

14. A self-contained sound effects system for a toy vehicle, said toy vehicle having a remote transmitter for transmitting electromagnetic signals through air to said toy vehicle, said transmitted electromagnetic signals containing one or a plurality of internal control signals for the operation of said toy vehicle, said self-contained system comprising:

means located in said toy vehicle and receptive of said transmitted electromagnetic signals for detecting said internal control signals, means located in said toy vehicle and connected to said detecting means for generating sound data coordinated with said detected internal control signals, said generating means comprising:

a. means for delivering sound data corresponding to a plurality of predetermined realistic sounds for said toy vehicle, b. means receptive of said detected internal control signals from said detecting means and of said sound data from said sound data delivering means for outputting sound data coordinated with said detected internal control signals, and means located in said toy vehicle and receptive of said outputted sound data from said generating means for producing a realistic sound corresponding to said sound data.

15. The self-contained system of claim 14 wherein said sound data delivering means includes a sound synthesizer.

16. The self-contained system of claim 14 further comprising means located in said toy vehicle for sensing at least one physical condition of said toy vehicle, said generating means being responsive to said sensed physical condition for outputting sound data coordinated with said sensed physical condition.

17. The self-contained system of claim 16 wherein said sensing means is a sensor located on said toy vehicle for sensing when said toy vehicle strikes an object thereby activating said generating means to output a crash sound.

18. The self-contained system of claim 16 wherein said sensing means is a sensor located on said toy vehicle for sensing when said toy vehicle rolls over thereby activating said generating means to output a crash sound.

19. The self-contained system of claim 16 wherein said sensing means is a sensor located on said toy vehicle for sensing when said toy vehicle turns too quickly thereby activating said generating means to output a crash sound.

20. The self-contained system of claim 14 further comprising means located in said toy vehicle for sensing the presence of at least ne external stimulus directed towards said toy vehicle, said generating means being responsive to said sensed external stimulus for outputting sound data coordinated with said sensed external stimulus.

21. The self-contained system of claim 14 further comprising means remote from said toy vehicle for delivering asynchronous sound effect signals to said generating means and means in said generating means receiving said asynchronous sound effect signals for outputting sound data corresponding to said asynchronous sound effect signals.

22. The self-contained system of claim 14 wherein said sound modification includes changing the pitch, timbre, or amplitude, of said sound.

23. The self-contained system of claim 14 further comprising a communications port connected to said generating means and a remote computer selectively engaging said communications port for changing the contents of said sound data delivering means and said program storing means.

24. The self-contained system of claim 23 further comprising means located on said computer for performing a physical function on said toy vehicle.

25. The self-contained system of claim 14 wherein said generating means averages a predetermined number of said internal control pulses in order to minimize the presence of noise and spurious pulses.

* * * * *